US011056068B2

(12) United States Patent
Toyota et al.

(10) Patent No.: US 11,056,068 B2
(45) Date of Patent: Jul. 6, 2021

(54) DISPLAY DEVICE PERFORMING PRECHARGE OF VIDEO SIGNAL LINES AND DRIVE METHOD THEREOF

(71) Applicant: SHARP KABUSHIKI KAISHA, Sakai (JP)

(72) Inventors: Kazuya Toyota, Sakai (JP); Katsunori Tanaka, Sakai (JP)

(73) Assignee: SHARP KABUSHIKI KAISHA, Sakai (JP)

( * ) Notice: Subject to any disclaimer, the term of this patent is extended or adjusted under 35 U.S.C. 154(b) by 0 days.

(21) Appl. No.: 16/697,023

(22) Filed: Nov. 26, 2019

(65) Prior Publication Data

US 2020/0175935 A1 Jun. 4, 2020

Related U.S. Application Data

(60) Provisional application No. 62/773,777, filed on Nov. 30, 2018.

(51) Int. Cl.
*G09G 3/36* (2006.01)

(52) U.S. Cl.
CPC ..... *G09G 3/3614* (2013.01); *G09G 3/3688* (2013.01); *G09G 3/3696* (2013.01); *G09G 2310/0286* (2013.01); *G09G 2310/08* (2013.01); *G09G 2330/023* (2013.01)

(58) Field of Classification Search
CPC .. G09G 3/3614; G09G 3/3696; G09G 3/3688; G09G 2330/023; G09G 2310/08; G09G 2310/0286
See application file for complete search history.

(56) References Cited

U.S. PATENT DOCUMENTS

| | | | | |
|---|---|---|---|---|
| 7,663,594 | B2 * | 2/2010 | Do | G09G 3/3688 345/100 |
| 2003/0006955 | A1 * | 1/2003 | Tsuchi | G09G 3/3688 345/92 |
| 2005/0007334 | A1 * | 1/2005 | Park | G09G 3/36 345/102 |
| 2006/0291309 | A1 * | 12/2006 | Maki | G09G 3/3688 365/203 |
| 2007/0046613 | A1 * | 3/2007 | Ha | G09G 3/3688 345/98 |
| 2007/0171169 | A1 | 7/2007 | Hirama | |
| 2009/0174698 | A1 | 7/2009 | Kida et al. | |
| 2015/0310812 | A1 * | 10/2015 | Chen | G09G 3/20 345/691 |

FOREIGN PATENT DOCUMENTS

| | | |
|---|---|---|
| JP | 2007-199203 A | 8/2007 |
| JP | 2009-015334 A | 1/2009 |
| JP | 2009-163246 A | 7/2009 |

* cited by examiner

*Primary Examiner* — Kwang-Su Yang
(74) *Attorney, Agent, or Firm* — ScienBiziP, P.C.

(57) ABSTRACT

The display device is provided with a precharge power source that supplies only precharge voltages (precharge voltages corresponding to the maximum gradation value for each of the positive polarity and the negative polarity) corresponding to one gradation value. The source driver includes a data voltage generation circuit configured to generate data voltage depending on input data and an output circuit configured to apply the data voltage to each source bus line after applying precharge voltage. The output circuit changes the length of the precharging period during which the precharge voltage is applied to each source bus line, depending on input data.

5 Claims, 7 Drawing Sheets

DISPLAY DEVICE PERFORMING PRECHARGE OF VIDEO SIGNAL LINES AND DRIVE METHOD THEREOF

CROSS REFERENCE TO RELATED APPLICATIONS

This application claims priority to U.S. Provisional Patent Application No. 62/773,777, entitled "DISPLAY DEVICE AND DRIVE METHOD THEREOF", filed on Nov. 30, 2018, the content of which is incorporated herein by reference.

BACKGROUND OF THE INVENTION

1. Field of the Invention

The following disclosure relates to a display device, in particular, to a display device that performs precharging of source bus lines (video signal lines).

2. Description of Related Art

In recent years, regarding display devices such as liquid crystal display devices, an increase in size, an increase in definition, and an increase in luminance have been promoted for a panel. In the liquid crystal display device, image display is realized by charging/discharging of the liquid crystal. In order to perform charging/discharging of the liquid crystal, a source driver (a video signal line drive circuit) applies data voltages (gradation voltages) depending on input data to source bus lines. Thus, currents flow through the source bus lines and power is consumed. In the meantime, when an increase in size and an increase in definition are realized for a panel, the load in the panel is increased. Accordingly, an increase in size and an increase in definition for a panel cause an increase in power consumption. In addition, in order to realize an increase in luminance, there is a need to apply a high voltage to the liquid crystal so that the transmittance is increased as much as possible. Accordingly, an increase in luminance also causes an increase in power consumption.

Conventionally, a technique in which the power consumption is reduced by performing precharging of the source bus lines is proposed. According to this technique, precharging is performed when the polarity of the data voltage applied to the source bus line is changed. For example, as shown in FIG. 10, the precharging period Tp is provided when the horizontal scanning period is switched, and the main charging period (the period during which data voltages depending on input data are applied to source bus lines) Tc is provided following the precharging period Tp. Since the source potential (the potential of the source bus line) VS is changed based on the voltage supplied from the power source for precharging in the precharging period Tp (the source potential VS comes close to the target potential in the precharging period Tp), the power consumption caused by applying the data voltages depending on input data to the source bus lines is reduced as compared to the configuration in which precharging is not performed. However, according to the conventional technique in which precharging of the source bus lines is performed, the source bus line can be precharged only to a certain potential (for example, the ground potential or the VCC potential). Therefore, the effect of reducing the power consumption is small. It should be noted that Japanese Laid-Open Patent Publication Mo. 2009-15334 and Japanese Laid-Open Patent Publication No. 2009-163246 disclose a technique in which the length of the precharging period can be varied.

In view of the above circumstances, Japanese Laid-Open Patent Publication No. 2007-199203 has proposed a method in which a plurality of power sources for precharging are provided and the precharge potential is changed depending on the input data (the gradation value indicated by the input data). However, according to this method, the cost is increased because the plurality of power sources for precharging are required.

SUMMARY OF THE INVENTION

Thus, regarding the display device, it is desired to realize decrease in power consumption at low cost.

(1) Display devices according to several embodiments of the present invention are each a display device having a plurality of video signal lines and a video signal line drive circuit configured to drive the plurality of video signal lines, the display device including:

a precharge power source, as a power source for performing precharging of the plurality of video signal lines, configured to supply only a precharge voltage corresponding to one gradation value, wherein the video signal line drive circuit includes a data voltage generation circuit configured to generate a data voltage depending on input data, and an output circuit configured to apply the data voltage to each of the plurality of video signal lines after applying the precharge voltage, and the output circuit changes a length of a precharging period during which the precharge voltage is applied to each of the plurality of video signal lines, depending on the input data.

According to such a configuration, the output circuit in the video signal line drive circuit applies the precharge voltage before applying the data voltage depending on the input data, to each video signal line. Here, the output circuit changes the length of the precharging period depending on the input data. Therefore, even when only a voltage corresponding to one gradation value is prepared as a voltage for precharging, it is possible to make the potential of the video signal line come close to the target potential by end of the precharging period. Since precharging of the video signal lines is performed in this manner, it is possible to achieve decrease in power consumption. Moreover, since the precharge power source that supplies only a precharge voltage corresponding to one gradation value is prepared as the power source for precharging, increase in cost is suppressed. From the above, regarding the display device, decrease in power consumption can be realized at low cost.

(2) Moreover, display devices according to several embodiments of the present invention are each a display device including the configuration of above (1), wherein the precharge power source supplies, as the precharge voltage, a voltage for a positive polarity corresponding to a maximum gradation value and a voltage for a negative polarity corresponding to the maximum gradation value.

(3) Moreover, display devices according to several embodiments of the present invention are each a display device including the configuration of above (2), wherein the output circuit includes a precharge voltage selection unit configured to select the precharge voltage for the positive polarity or the precharge voltage for the negative polarity based on a first switching signal, an output voltage selection unit configured to select the data voltage or the precharge voltage selected by the precharge voltage selection unit, based on a second switching signal, and a switching signal generation unit configured to generate the first switching signal based on a polarity control signal for determining a polarity of the data voltage applied to each of the plurality of video signal lines, and generate the second switching signal based on the input data.

(4) Moreover, display devices according to several embodiments of the present invention are each a display device including the configuration of above (3), wherein the switching signal generation unit includes a look-up table that associates the input data with the length of the precharging period, and generates the second switching signal so that the precharging period whose length is determined by referring to the look-up table based on the input data is obtained.

(5) Moreover, display devices according to several embodiments of the present invention are each a display device including the configuration of above (3), wherein the switching signal generation unit generates the second switching signal based on only input data for a target horizontal scanning period.

(6) Moreover, display devices according to several embodiments of the present invention are each a display device including the configuration of above (5), wherein the output circuit further includes a short-circuiting control unit configured to make two video signal lines constituting each set short-circuited for only a predetermined period when switching a horizontal scanning period, the each set being two video signal lines to which data voltages of different polarities are applied in each horizontal scanning period.

(7) Moreover, display devices according to several embodiments of the present invention are each a display device further including the configuration of above (3), wherein the display device further includes an input data storing unit configured to hold input data for one horizontal scanning period, and the switching signal generation unit generates the second switching signal based on input data for a target horizontal scanning period and input data, that is held in the input data storing unit, for a period one horizontal scanning period before the target horizontal scanning period.

(8) Moreover, drive methods for a display device according to several embodiments of the present invention are each a drive method for a display device having a plurality of video signal lines and a video signal line drive circuit configured to drive the plurality of video signal lines, wherein the display device includes a precharge power source, as a power source for performing precharging of the plurality of video signal lines, configured to supply only a precharge voltage corresponding to one gradation value, the drive method includes a data voltage generation step of generating a data voltage depending on input data, and an output step of applying the data voltage to each of the plurality of video signal lines after applying the precharge voltage, and a length of a precharging period during which the precharge voltage is applied to each of the plurality of video signal lines in the output step is changed depending on the input data.

These and other objects, features, aspects, and effects of the present invention will be made more clear from the following detailed description of the present invention with reference to the accompanying drawings.

DETAILED DESCRIPTION OF PREFERRED EMBODIMENTS

Hereinafter, embodiments will be described with reference to the accompanying drawings.

1. First Embodiment

1.1 Overall Configuration

Figure 2:
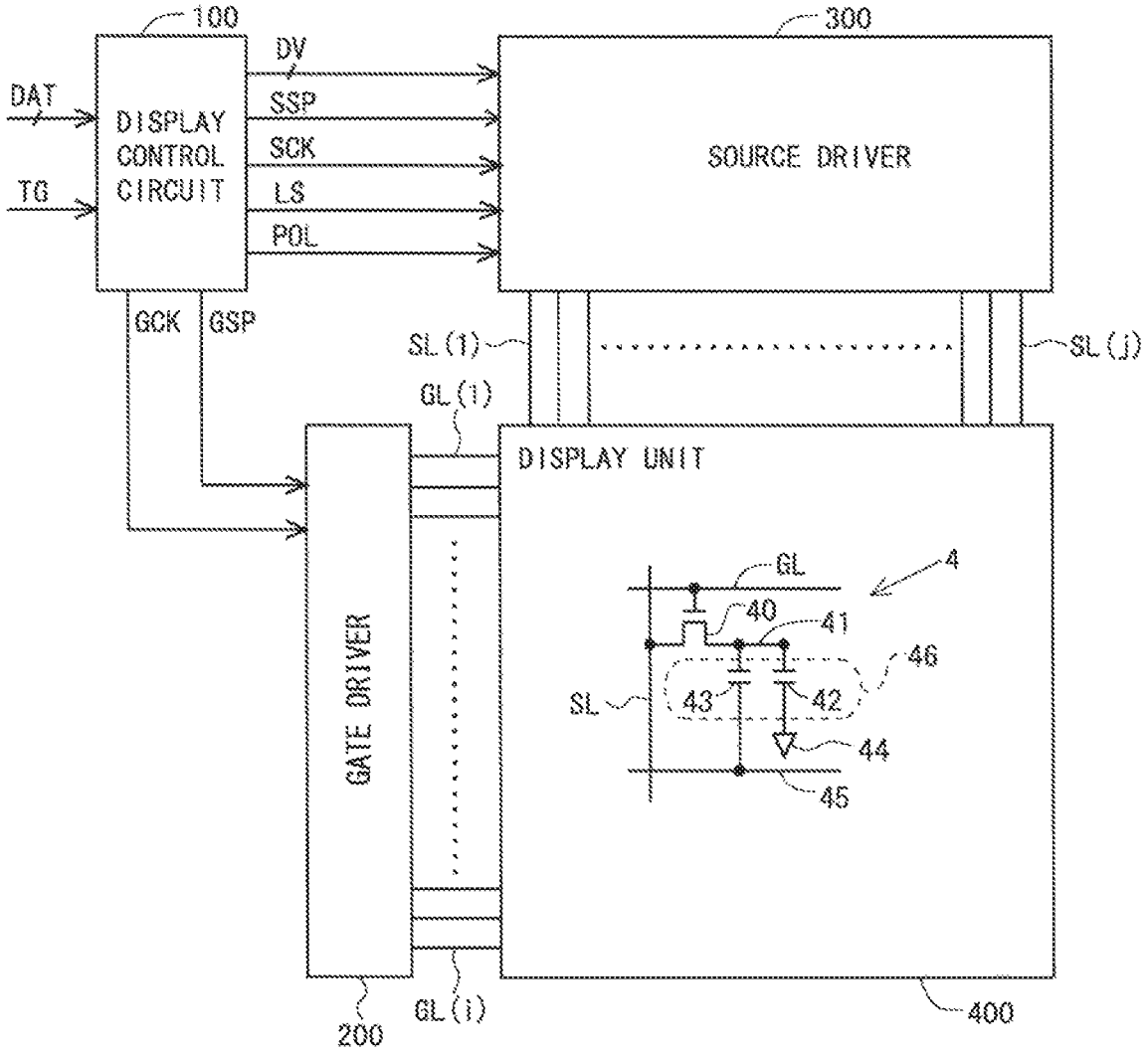
FIG. 2 is a block diagram showing an overall configuration of a liquid crystal display device according to the first embodiment.

FIG. 2 is a block diagram showing an overall configuration of a liquid crystal display device according to a first embodiment. The liquid crystal display device includes a display control circuit 100, a gate driver 200, a source driver 300, and a display unit 400.

A plurality of (i) gate bus lines (scanning signal lines) GL(1) to GL(i) and a plurality of (j) source bus lines (video signal lines) SL(1) to SL(j) are disposed in the display unit 400. A pixel formation portion 4 forming a pixel is provided in correspondence with each intersection point of the gate bus lines GL(1) to GL(i) and the source bus lines SL(1) to SL(j). That is, a plurality of (i×j) pixel formation portions 4 are included in the display unit 400. The plurality of pixel formation portions 4 are arranged in a matrix, and configure a pixel matrix. Each pixel formation portion 4 includes a thin-film transistor (TFT) 40, which is a switching element having a gate electrode connected to the gate bus line GL passing through a corresponding intersection point and a source electrode connected to the source bus line SL passing through the intersection point, a pixel electrode 41 connected to a drain electrode of the TFT 40, a common electrode 44 and an auxiliary capacitance electrode 45 provided in common to the plurality of pixel formation portions 4, a liquid crystal capacitance 42 formed by the pixel electrode 41 and the common electrode 44, and an auxiliary capacitance 43 formed by the pixel electrode 41 and the auxiliary capacitance electrode 45. The liquid crystal capacitance 42 and the auxiliary capacitance 43 form a pixel capacitance 46. It should be noted that structural elements corresponding to only one pixel formation portion 4 are shown in the display unit 400 in FIG. 2.

Next, operations of the structural elements shown in FIG. 2 will be described. The display control circuit 100 receives an image signal (an input data) DAT and a timing signal group TG, such as a horizontal synchronization signal and a vertical synchronization signal, that are supplied from outside, and outputs a digital video signal DV; a gate start pulse signal GSP and a gate clock signal GCK for controlling an operation of the gate driver 200; and a source start pulse signal SSP, a source clock signal SCK, a latch strobe signal LS, and a polarity control signal POL for controlling an operation of the source driver 300.

The gate driver 200 repeats application of active scanning signals to each of the gate bus lines GL(1) to GL(i) with one vertical scanning period as a cycle, based on the gate start pulse signal GSP and the gate clock signal GCK transmitted from the display control circuit 100.

The source driver 300 receives the digital video signal DV, the source start pulse signal SSP, the source clock signal SCK, the latch strobe signal LS, and the polarity control signal POL transmitted from the display control circuit 100, and applies data voltages corresponding to gradation values indicated by the digital video signal DV (gradation voltages corresponding to the input data) to the source bus lines SL(1) to SL(j). It should be noted that a description will be made later in detail of the source driver 300.

As described above, by applying the scanning signals to the gate bus lines GL(1) to GL(i), and by applying the data voltages to the source bus lines SL(1) to SL(j), an image corresponding to the image signal DAT that is externally supplied is displayed in the display unit 400.

1.2 Source Driver (Video Signal Line Drive Circuit)

1.2.1 Overall Configuration of Source Driver

Figure 3:
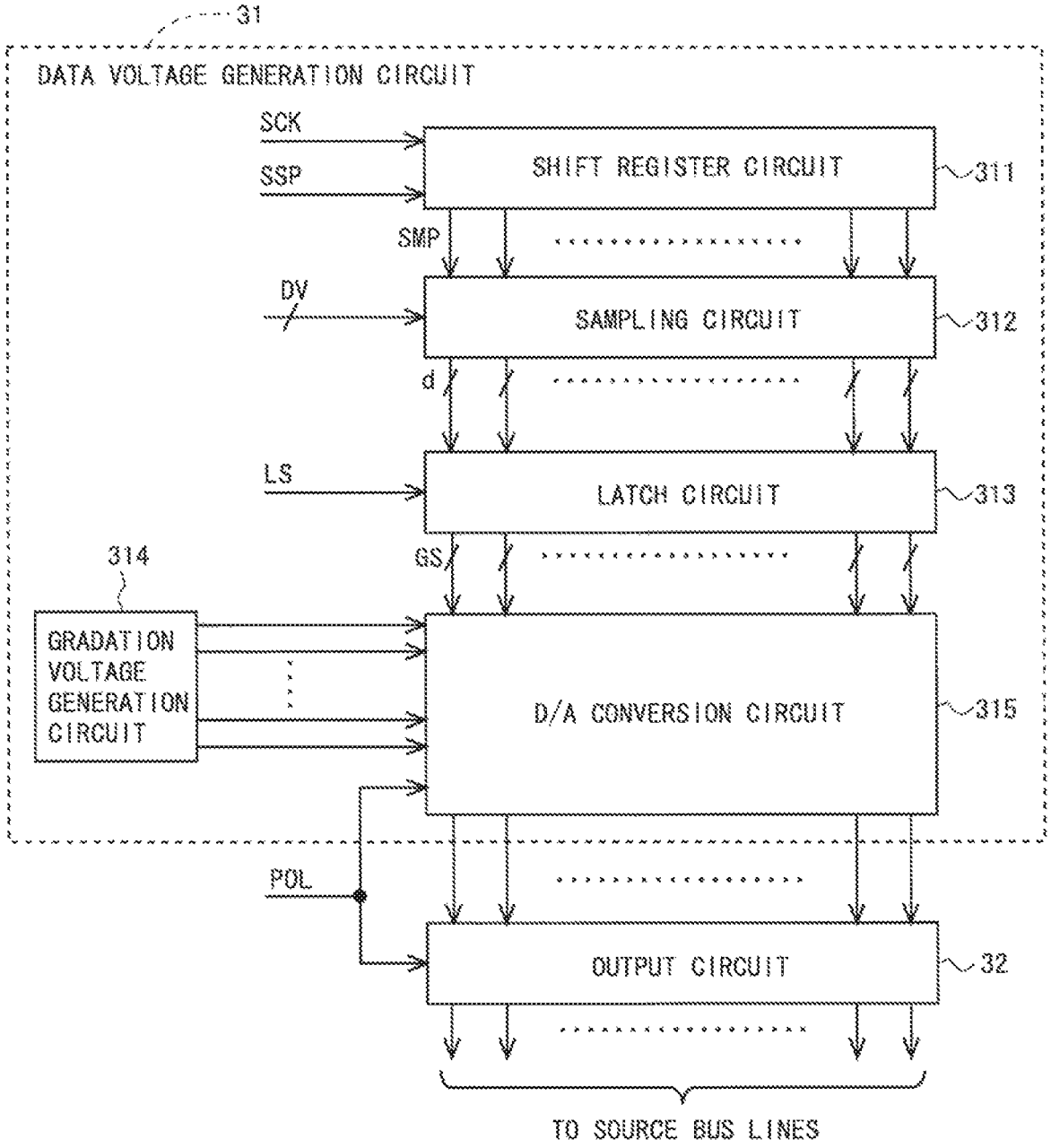
FIG. 3 is a block diagram showing an overall configuration of a source driver according to the first embodiment.

FIG. 3 is a block diagram showing an overall configuration of the source driver 300. As shown in FIG. 3, the source driver 300 includes a data voltage generation circuit 31 and an output circuit 32. The data voltage generation circuit 31 includes a shift register circuit 311, a sampling circuit 312, a latch circuit 313, a gradation voltage generation circuit 314, and a D/A conversion circuit 315. Hereinafter, operations of the structural elements shown in FIG. 3 will be described.

The source start pulse signal SSP and the source clock signal SCK are inputted into the shift register circuit 311. The shift register circuit 311 transfers a pulse included in the source start pulse signal SSP sequentially from an input terminal to an output terminal based on the source clock signal SCK. Sampling pulses SMP for the respective source bus lines SL(1) to SL (j) are sequentially outputted from the shift register circuit 311 based on the transfer of the pulse, and the sampling pulses SMP are sequentially inputted into the sampling circuit 312.

The sampling circuit 312 samples digital video signals (signals corresponding to the input data) DV transmitted from the display control circuit 100, at timing of the sampling pulses SMP outputted from the shift register circuit 311, and outputs the sampled digital video signals DV as internal image signals d. The latch circuit 313 takes in the internal image signals d outputted from the sampling circuit 312, at timing of a pulse of the latch strobe signal LS, and outputs the internal image signals d as gradation signals.

The gradation voltage generation circuit 314 generates gradation voltages for each of the positive polarity and the negative polarity based on a reference voltage, the number of the gradation voltages is equal to the number of gradations displayable at this liquid crystal display device. The gradation voltages generated by the gradation voltage generation circuit 314 are supplied to the D/A conversion circuit 315.

The D/A conversion circuit 315 selects any of the gradation voltages supplied from the gradation voltage generation circuit 314, based on the polarity control signal POL and the gradation signal GS outputted from the latch circuit 313, and outputs the selected voltage as a data voltage, for each column. The data voltages outputted from the D/A conversion circuit 315 are inputted into the output circuit 32.

The output circuit 32 performs impedance transformation on the data voltage outputted from the D/A conversion circuit 315, and outputs the transformed data voltage to the source bus line SL, for each column. In this regard, in the present embodiment, precharging of the source bus lines SL is performed. The configuration and the operation for the precharging will be described later.

1.2.2 Configuration of Output Circuit

Figure 4:
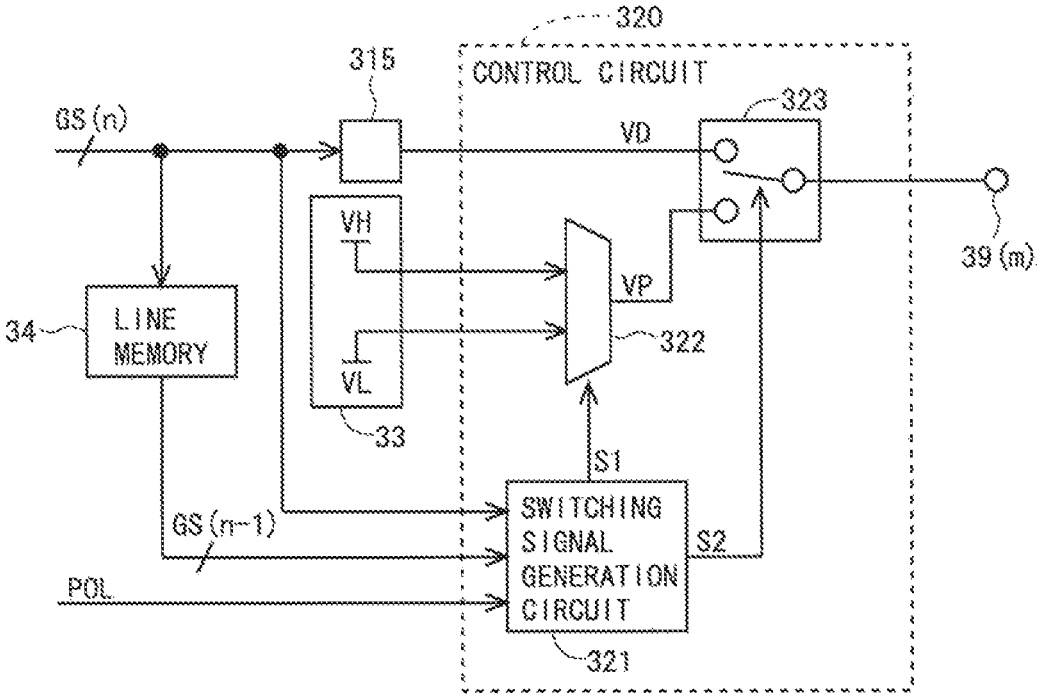
FIG. 4 is a circuit diagram for describing an output circuit in the source driver according to the first embodiment.

Next, a configuration of the output circuit 32 in the source driver 300 will be described. FIG. 4 is a circuit diagram for describing the output circuit 32 according to the present embodiment. It should be noted that FIG. 4 shows structural elements corresponding to one source bus line SL (here, a source bus line SL(m) of the m-th column is focused on), and the circuit configured by those structural elements is referred to as a "control circuit". The control circuit will be denoted by reference numeral 320.

As shown in FIG. 4, the control circuit 320 includes a switching signal generation unit 321, a selector 322, and a switching switch 323. A line memory 34 (not shown in FIG. 3) is provided outside the control circuit 320. In the present embodiment, as voltages for precharging, only voltages corresponding to one gradation value are used. More specifically, as voltages for precharging, a high-level voltage VH that is a positive-polarity voltage corresponding to the maximum gradation value and a low-level voltage VL that is a negative-polarity voltage corresponding to the maximum gradation value are used. In order to realize this, the liquid crystal display device in the present embodiment is provided with a precharge power source 33 that supplies precharge voltages (a high-level voltage VH and a low-level voltage VL) corresponding to the maximum gradation value for each of the positive polarity and the negative polarity. In other words, the liquid crystal display device in the present embodiment is provided with a precharge power source 33 that corresponds to a reference power source for outputting data voltages from the source driver 300. It should be noted that, although an output amplifier for performing impedance transformation on the data voltages is provided in the output circuit 32, the output amplifier is not shown in FIG. 4. For example, the output amplifier is provided between the D/A conversion circuit 315 and the switching switch 323.

A polarity control signal POL for determining the polarity of the data voltage applied to each source bus line SL, a gradation signal GS(n) for a row (here, n-th row) that is a current writing target, and a gradation signal GS(n−1) for a row that is a writing target before one horizontal scanning period are inputted into the switching signal generation unit 321. Since the gradation signal GS(n−1) is required in the present embodiment as described above, the line memory 34 for holding the gradation signal GS(n) for one horizontal scanning period is provided. The switching signal generation unit 321 generates a first switching signal S1 based on the polarity control signal POL. In addition, the switching signal generation unit 321 generates a second switching signal S2 based on the input data. More specifically, the switching signal generation unit 321 generates the second switching signal S2 based on the gradation signal GS(n) and the gradation signal GS (n−1). The first switching signal S1 is supplied to the selector 322, and the second switching signal S2 is supplied to the switching switch 323.

The high-level voltage VH and the low-level voltage VL are supplied to the selector 322. The selector 322 selects the high-level voltage VH or the low-level voltage VL based on the first switching signal S1, and outputs the selected voltage as a precharge voltage VP. Here, it is assumed that the selector 322 selects the high-level voltage VH when the first switching signal S1 is at high level and the selector 322 selects the low-level voltage VL when the first switching signal S1 is at low level. In a case in which the polarity of the data voltage changes from the negative polarity to the positive polarity when switching the horizontal scanning period, the first switching signal S1 becomes high level so that the high-level voltage VH is selected by the selector 322. On the other hand, in a case in which the polarity of the data voltage changes from the positive polarity to the negative polarity when switching the horizontal scanning period, the first switching signal S1 becomes low level so that the low-level voltage VL is selected by the selector 322.

The switching switch 323 supplies an output terminal 39(*m*) with the precharge voltage VP or the data voltage VD that is a target voltage to be applied to the source bus line SL (m) and is an output voltage from the D/A conversion circuit 315, based on the second switching signal S2. The output terminal 39(*m*) is an output terminal that is connected to the source bus line SL(m) of the m-th column. Here, it is assumed that the precharge voltage VP is supplied to the output terminal 39(*m*) when the second switching signal S2 is at high level and the data voltage VD is supplied to the output terminal 39(*m*) when the second switching signal S2 is at low level. Namely, the period during which the second switching signal S2 is maintained at high level is the precharging period Tp.

It should be noted that, in the present embodiment, a precharge voltage selection unit is realized by the selector 322, an output voltage selection unit is realized by the switching switch 323, and an input data storing unit is realized by the line memory 34.

1.2.3 Operation of Control Circuit in Output Circuit

Figure 5:
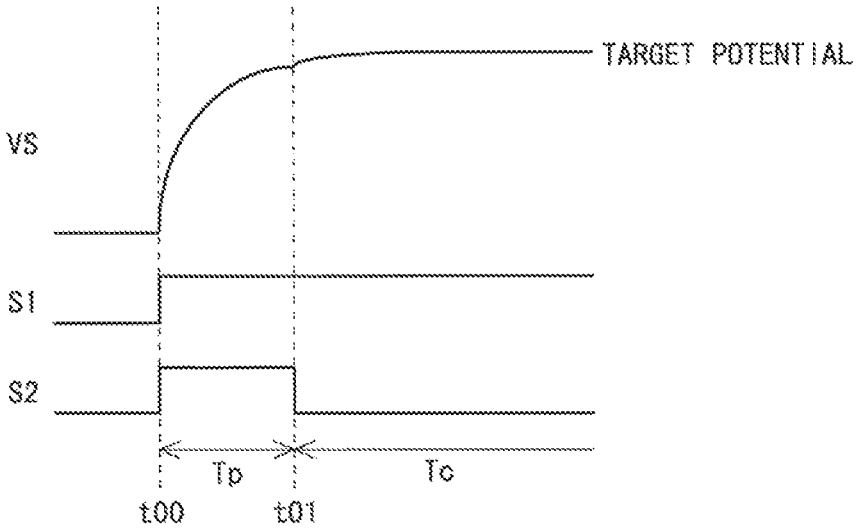
FIG. 5 is a signal waveform diagram for describing an operation of a control circuit in the output circuit according to the first embodiment.

FIG. 5 is a signal waveform diagram for describing an operation of the control circuit 320 in the output circuit 32. Here, a case in which the polarity of the data voltage changes from the negative polarity to the positive polarity when switching the horizontal scanning period is focused on. Regarding FIG. 5, VS represents a source potential of the source bus line SL(m) of the m-th column, and time point t00 represents a timing of switching the horizontal scanning period.

When time point t00 comes, the first switching signal S1 changes from low level to high level. Accordingly, the selector 322 selects the high-level voltage VH. Namely, as the precharge voltage VP, the high-level voltage VH is outputted from the selector 322. In addition, at time point t00, the second switching signal S2 changes from low level to high level. Accordingly, the switching switch 323 supplies the output terminal 39(*m*) with the high-level voltage VH as the precharge voltage VP. As a result, the high-level voltage VH is applied to the source bus line SL(m), and therefore the source potential VS rises as shown in FIG. 5.

When time point t01 comes, the second switching signal S2 changes from high level to low level. Accordingly, the switching switch 323 supplies the output terminal 39(*m*) with the data voltage VD. Namely, when time point t01 comes, the precharging period Tp ends, and the main charging period Tc during which charging of source bus lines SL by the data voltages VD is performed starts. By end of the main charging period Tc, the source potential VS reaches the target potential.

Figure 6:
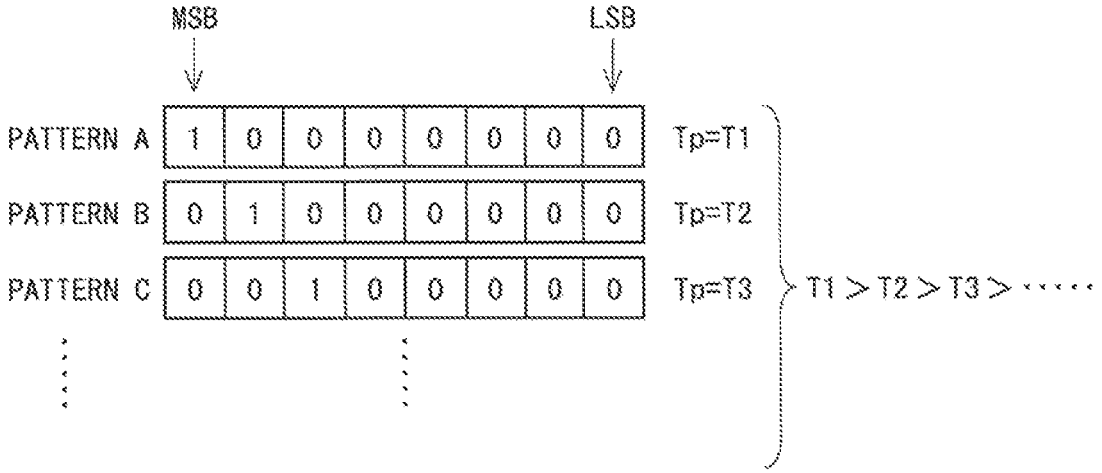
FIG. 6 is a diagram for describing a length of a precharging period according to the first embodiment.

In the meantime, in the present embodiment, roughly, the higher the gradation value (the value of the gradation signal GS) after switching of the horizontal scanning period is, the longer the precharging period Tp is. Regarding this, if the gradation signal GS is 8-bit data, the closer the bit firstly assigned to "1" is to the most significant bit MSB, the longer the precharging period Tp is, as shown in FIG. 6. The length of the precharging period Tp is equal to the length of the period during which the second switching signal S2 is maintained at high level. Accordingly, the closer the bit firstly assigned to "1" is to the most significant bit MSB, the longer the period during which the second switching signal S2 is maintained at high level is.

However, in the present embodiment, in order to make the source potential VS after the end of precharging come close to the target potential, the length of the precharging period Tp is determined in consideration of not only the gradation value after switching of the horizontal scanning period but also the gradation value before switching of the horizontal scanning period. Specifically, the larger the width of change of the gradation value (the width of change of the data voltage) before and after switching of the horizontal scanning period is, the longer the precharging period Tp is. In order to realize this, a look-up table that associates "the combination of the value of the gradation signal GS(n) and the value of the gradation signal GS (n−1)" as input data with the length of the precharging period Tp is provided in the switching signal generation unit 321. Thereby, the switching signal generation unit 321 can lengthen the precharging period Tp (the period during which the second switching signal S2 is maintained at high level) as the difference between the value of the gradation signal GS(n) and the value of the gradation signal GS(n−1) increases, and can shorten the precharging period Tp as the difference between the value of the gradation signal GS (n) and the value of the gradation signal GS(n−1) decreases.

Figure 1:
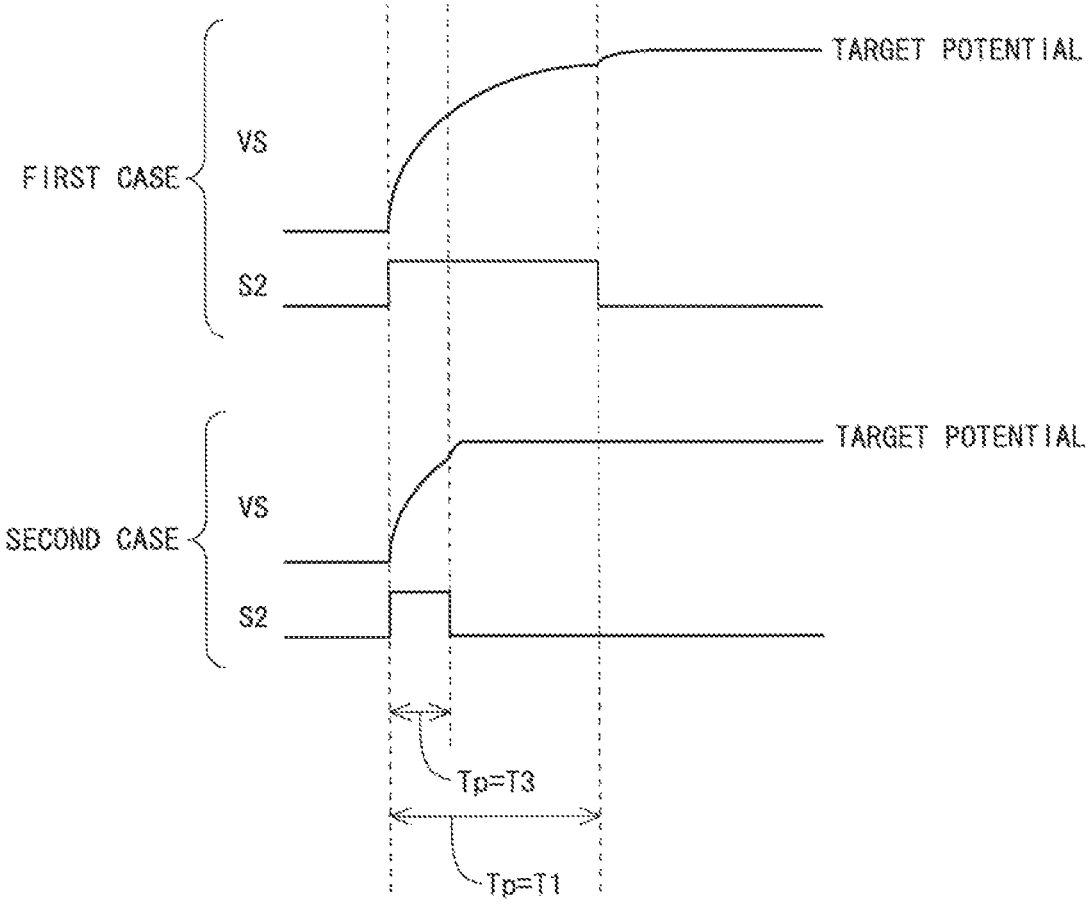
FIG. 1 is a signal waveform diagram for describing a difference in operation caused by a difference in the input data according to a first embodiment.

Here, referring to FIG. 1, we compare a case where the data after switching of the horizontal scanning period (the gradation signal GS(n)) is the data of the pattern A in FIG. 6 (hereinafter referred to as a "first case") to a case where it is the data of the pattern C in FIG. 6 (hereinafter referred to as a "second case"). It is assumed that the data before switching of the horizontal scanning period (the gradation signal GS(n−1)) is the same for the first case and the second case. The target potential in the first case is higher than that in the second case. Accordingly, as shown in FIG. 1, the period during which the second switching signal S2 is maintained at high level in the first case is longer than that in the second case. Namely, the length T1 of the precharging period Tp in the first case is longer than the length T3 of the precharging period Tp in the second case. Therefore, the source potential VS rises to relatively high level in the precharging period Tp in the first case, but the source potential VS rises to relatively low level in the precharging period Tp in the second case. In this way, both in the first case and in the second case, the source potential VS rises to the potential near the the target potential in the precharging period Tp.

1.3 Effects

According to the present embodiment, the output circuit 32 in the source driver 300 applies the precharge voltage before applying the data voltage (the gradation voltage) depending on the input data, to each source bus line SL. Here, the output circuit 32 changes the length of the precharging period Tp during which the precharge voltage is applied to each source bus line SL, depending on the input data. Therefore, even when only one precharge voltage for the positive polarity and one precharge voltage for the negative polarity are prepared (namely, only precharge voltages corresponding to one gradation value are prepared), it is possible to make the source potential VS come close to the target potential by end of the precharging period Tp. Since precharging of the source bus lines SL is performed when switching the horizontal scanning period in this manner, it is possible to achieve decrease in power consumption. Moreover, since only precharge voltages corresponding to one gradation value are prepared as described above, increase in cost is suppressed. From the above, according to the present embodiment, regarding the liquid crystal display device, decrease in power consumption can be realized at low cost.

1.4 Variant

In the first embodiment, the length of the precharging period Tp (the length of the period during which the second switching signal S2 is maintained at high level) is determined based on the gradation signal GS(n) for a row that is a current writing target and the gradation signal GS(n−1) for a row that is a writing target before one horizontal scanning period. However, the present invention is not limited to this, and the length of the precharging period Tp may be determined based on only the gradation signal GS(n) for a row that is a current writing target. In this case, a look-up table that associates the value of the gradation signal GS(n) with the length of the precharging period Tp is provided in the switching signal generation unit 321.

According to the present variant, since the source potential VS at starting time point of the precharging period Tp is not considered, the difference between the source potential VS and the target potential at ending time point of the precharging period Tp (starting time point of the main charging period Tc) is larger as compared to that in the first embodiment. However, since the line memory 34 (see FIG. 4) is not required, power consumption can be decreased at lower cost.

2. Second Embodiment

2.1 Overview and Configuration of Output Circuit

In the present embodiment, for each color, data voltages of different polarities are applied to two adjacent source bus lines SL in each horizontal scanning period. Under such conditions, a processing called "charge share" in which two adjacent source bus lines SL are short-circuited for each color is performed when switching the horizontal scanning period.

Figure 7:
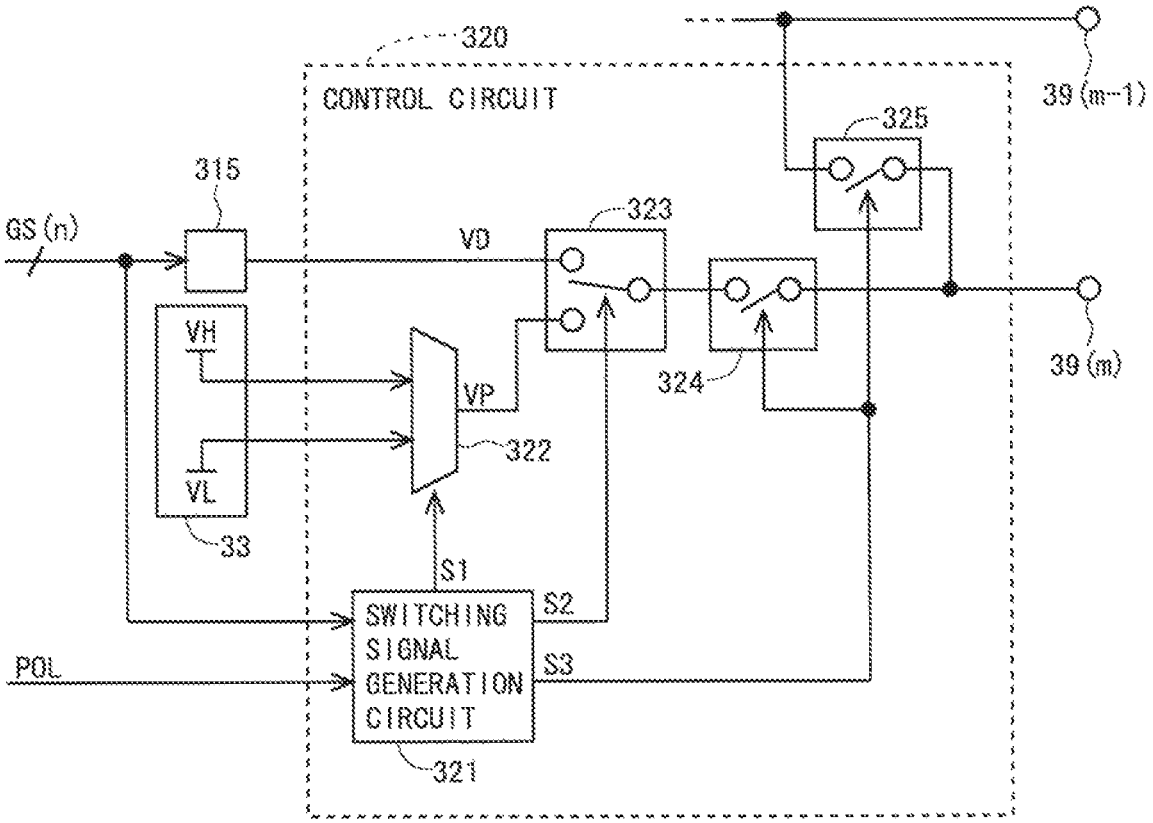
FIG. 7 is a circuit diagram for describing an output circuit in the source driver according to a second embodiment.

FIG. 7 is a circuit diagram for describing an output circuit 32 in the present embodiment. It should be noted that, in the following, differences from the first embodiment will be mainly described. Regarding FIG. 7, the output terminal 39(*m*) is an output terminal that is connected to the source bus line SL(m) of the m-th column for a certain color, and the output terminal 39(*m*−1) is an output terminal that is connected to the source bus line SL(m−1) of the (m−1)-th column for the color. Data voltages of different polarities are applied to the source bus line SL(m) and the source bus line SL (m−1) in each horizontal scanning period.

In the present embodiment, as shown in FIG. 7, the control circuit 320 includes a switching signal generation unit 321, a selector 322, a switching switch 323, a switch 324, and a switch 325. The switch 325 is shared by the control circuit 320 corresponding to the source bus line SL(m) and the control circuit 320 corresponding to the source bus line SL(m−1). Although the line memory 34 is provided outside the control circuit 320 in the first embodiment, the line memory 34 is not provided in the present embodiment.

The polarity control signal POL and the gradation signal GS(n) are inputted into the switching signal generation unit 321. The switching signal generation unit 321 generates a first switching signal S1 and a third switching signal S3 based on the polarity control signal POL. In addition, the switching signal generation unit 321 generates a second switching signal S2 based on the gradation signal GS(n) as the input data. The first switching signal S1 is supplied to the selector 322, the second switching signal S2 is supplied to the switching switch 323, and the third switching signal S3 is supplied to the switch 324 and the switch 325.

The selector 322 selects the high-level voltage VH or the low-level voltage VL based on the first switching signal S1, and outputs the selected voltage as a precharge voltage VP. The switching switch 323 outputs the data voltage VD or the precharge voltage VP based on the second switching signal S2.

Operations of the switch 324 and the switch 325 are controlled by the third switching signal S3. In the present embodiment, if the third switching signal S3 is at high level, then the switch 325 is in an ON state and the switch 324 is in an OFF state, and if the third switching signal S3 is at low level, then the switch 324 is in an ON state and the switch 325 is in an OFF state. Accordingly, during the period during which the third switching signal S3 is maintained at high level, the source bus line SL(m) and the source bus line SL(m−1) are short-circuited. On the other hand, during the period during which the third switching signal S3 is maintained at low level, the data voltage VD or the presharge voltage VP is supplied to the output terminal 39 (*m*).

It should be noted that, in the present embodiment, a precharge voltage selection unit is realized by the selector 322, an output voltage selection unit is realized by the switching switch 323, an input data storing unit is realized by the line memory 34, and a short-circuiting control unit is realized by the switch 324 and the switch 325.

2.2 Operation of Output Circuit

Figure 8:
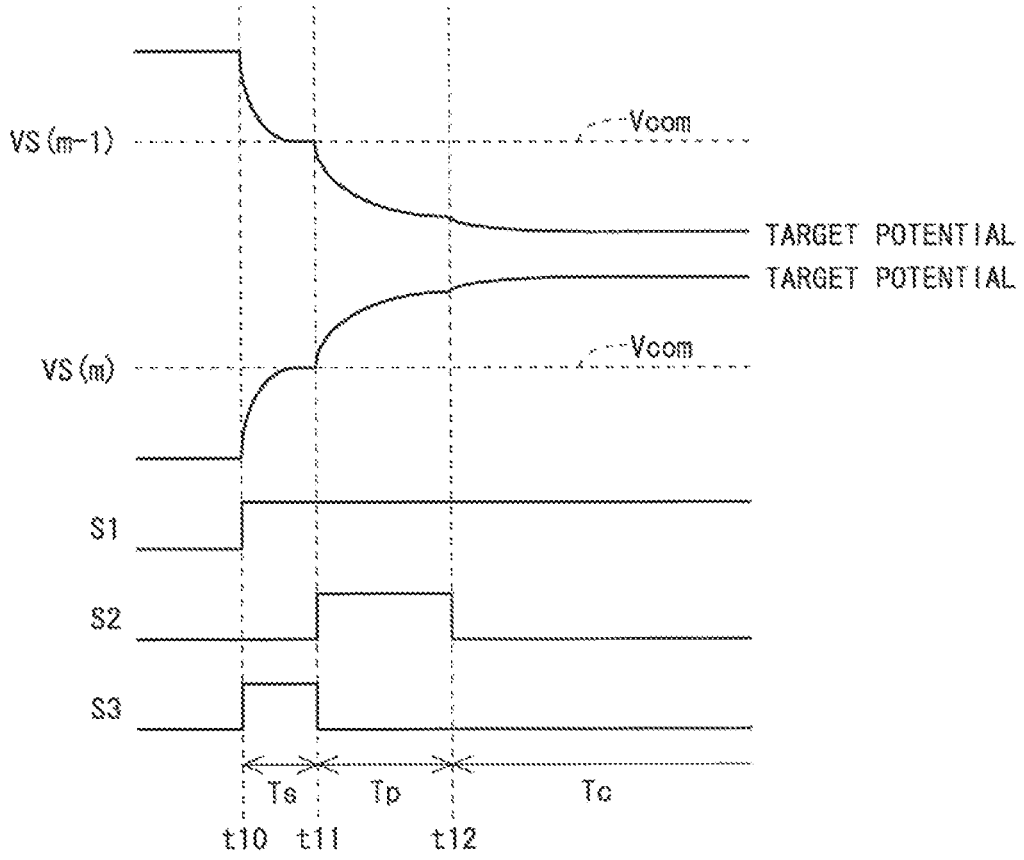
FIG. 8 is a signal waveform diagram for describing an operation of a control circuit in the output circuit according to the second embodiment.

FIG. 8 is a signal waveform diagram for describing an operation of the control circuit 320 in the output circuit 32. Here, a case in which the polarity of the data voltage changes from the negative polarity to the positive polarity at m-th column and the polarity of the data voltage changes from the positive polarity to the negative polarity at (m−1)-th column when switching the horizontal scanning period is focused on. Regarding FIG. 8, VS (m−1) represents a source potential of the source bus line SL (m−1) of the (m−1)-th column, VS (m) represents a source potential of the source bus line SL (m) of the m-th column, and time point t10 represents the timing of switching the horizontal scanning period.

When time point t10 comes, the third switching signal S3 changes from low level to high level. Accordingly, the switch 325 becomes ON state and the switch 324 becomes OFF state. Thus, the source bus line SL (m) and the source bus line SL(m−1) are short-circuited. As a result, the source potential VS(m−1) falls and the source potential VS(m) rises as shown in FIG. 8. The charge share period Ts during which two adjacent source bus lines are short-circuited in this manner continues until the third switching signal S3 changes from high level to low level. In the meantime, typically, to two adjacent source bus lines, data voltages corresponding to the gradation values which are almost the same are applied. Therefore, normally, the source potentials VS (m−1) and VS (m) become almost equal to the common electrode potential Vcom by end of the charge share period Ts. In addition, at time point t10, the first switching signal S1 changes from low level to high level. Accordingly, the selector 322 selects the high-level voltage VH. Namely, as the prechage voltage VP, the high-level voltage VH is outputted from the selector 322.

When time point t11 comes, the third switching signal S3 changes from high level to low level. Accordingly, the switch 324 becomes ON state and the switch 325 becomes OFF state. Namely, the charge share period Ts ends. In addition, at time point t11, the second switching signal S2 changes from low level to high level. Accordingly, the switching switch 323 supplies the output terminal 39(*m*) with the high-level voltage VH as the precharge voltage VP. As a result, the high-level voltage VH is applied to the source bus line SL(m), and therefore the source potential VS (m) rises as shown in FIG. 8. It should be noted that, in the (m−1)-th column, the low-level voltage VL is supplied to the output terminal 39(*m*). As a result, the low-level voltage VL is applied to the source bus line SL(m−1), and therefore the source potential VS(m−1) falls as shown in FIG. 8.

When time point t2 comes, the second switching signal S2 changes from high level to low level. Accordingly, the switching switch 323 supplies the output terminal 39(*m*) with the data voltage VD. Also in the (m−1)-th column, the data voltage VD is supplied to the output terminal 39(*m*−1). In this manner, when time point t2 comes, the precharging period Tp ends, and the main charging period Tc during which charging of source bus lines SL by the data voltages VD is performed starts. By end of the main charging period Tc, the source potentials VS(m−1) and VS(*m*) reach the target potentials.

Also in the present embodiment, the higher the gradation value (the value of the gradation signal GS) after switching of the horizontal scanning period is, the longer the precharging period Tp is. Namely, if the gradation signal GS is 8-bit data, the closer the bit firstly assigned to "1" is to the most significant bit MSB, the longer the precharging period Tp is, as shown in FIG. 6, as in the first embodiment.

Figure 9:
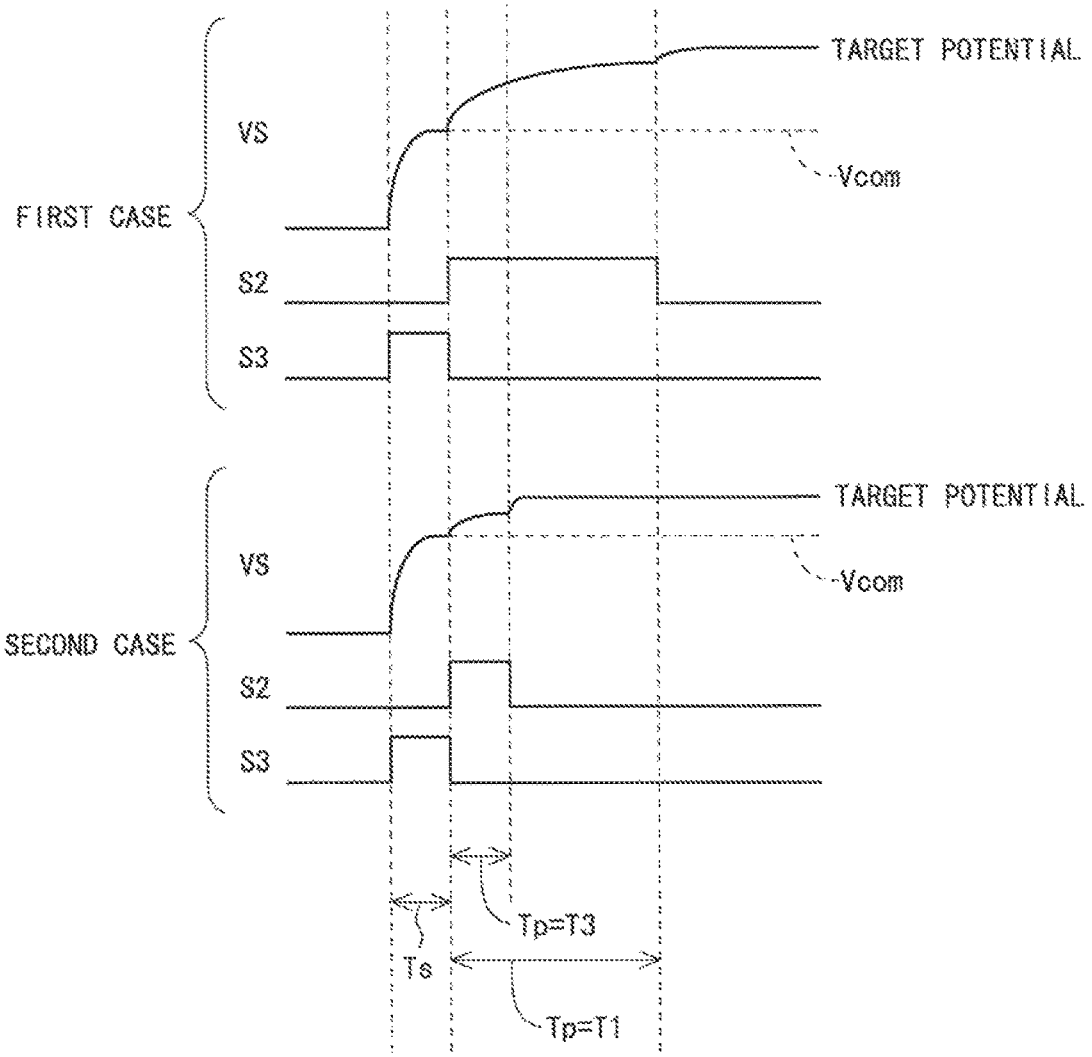
FIG. 9 is a signal waveform diagram for describing a difference in operation caused by a difference in the input data according to the second embodiment.
Figure 10:
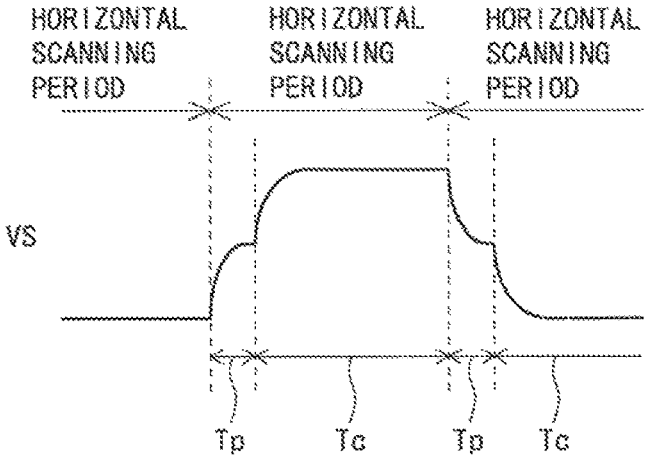
FIG. 10 is a signal waveform diagram for describing precharging of a source bus line.

Here, referring to FIG. 9, we compare a case where the data after switching of the horizontal scanning period (the gradation signal GS(n)) is the data of the pattern A in FIG. 6 (first case) to a case where it is the data of the pattern C in FIG. 6 (second case). First, regardless of the target potential, the source potential VS becomes almost equal to the common electrode potential Vcom by end of the charge share period Ts. Since the target potential in the first case is higher than that in the second case, as shown in FIG. 9, the length T1 of the precharging period Tp in the first case is longer than the length T3 of the precharging period Tp in the second case. Therefore, the source potential VS rises to relatively high level in the precharging period Tp in the first case, but the source potential VS rises to relatively low level in the precharging period Tp in the second case. In this way, both in the first case and in the second case, the source potential VS rises to the potential near the the target potential in the precharging period Tp.

2.3 Effects

According to the present embodiment, as in the first embodiment, precharging of the source bus lines SL is performed. Here, in the present embodiment, two source bus lines SL to which data voltages of different polarities are applied in each horizontal scanning period are taken as one set, and the output circuit 32 makes two source bus lines SL constituting each set short-circuited when switching the horizontal scanning period. Accordingly, the source potential VS at starting time point of the precharging period Tp becomes almost constant. Therefore, it is possible to set the length of the precharging period Tp to the preferred length without referring to information of gradation values before one horizontal scanning period. From the above, according to the present embodiment, it is possible to realize the liquid crystal display device in which power consumption can be effectively reduced at low cost.

3. Others

In the above, although the present invention has been described in detail, the above description is merely exemplary in every aspect, and not limiting. It is understood that various other alterations and modifications can be made without departing from the scope of the present invention.

For example, although the liquid crystal display device is described as an example in each embodiment, the present invention can also be applied to display devices other than the liquid crystal display device (for example, the present invention can be applied to the organic EL display device).

What is claimed is:

1. A display device having a plurality of video signal lines and a video signal line drive circuit configured to drive the plurality of video signal lines, the display device comprising:

a precharge power source, as a power source for performing precharging of the plurality of video signal lines, configured to supply a precharge voltage including a voltage for a positive polarity corresponding to a maximum gradation value and a voltage for a negative polarity corresponding to the maximum gradation value, the precharge voltage being corresponding to only one gradation value, wherein the video signal line drive circuit includes a data voltage generation circuit configured to generate a data voltage depending on input data, and an output circuit configured to apply the data voltage to each of the plurality of video signal lines after applying the precharge voltage, and the output circuit includes a precharge voltage selection unit configured to select the precharge voltage for the positive polarity or the precharge voltage for the negative polarity based on a first switching signal, an output voltage selection unit configured to select the data voltage or the precharge voltage selected by the precharge voltage selection unit, based on a second switching signal, and a switching signal generation unit configured to include a look-up table that associates the input data with a length of a precharging period, generate the first switching signal based on a polarity control signal for determining a polarity of the data voltage applied to each of the plurality of video signal lines, and generate the second switching signal so that the precharging period whose length is determined by referring to the look-up table based on the input data is obtained.

2. The display device according to claim 1, wherein the switching signal generation unit generates the second switching signal based on only input data for a target horizontal scanning period.

3. The display device according to claim 2, wherein the output circuit further includes a short-circuiting control unit configured to make two video signal lines constituting each set short-circuited for only a predetermined period when switching a horizontal scanning period, the each set being two video signal lines to which data voltages of different polarities are applied in each horizontal scanning period.

4. The display device according to claim 1, wherein the display device further includes an input data storing unit configured to hold input data for one horizontal scanning period, and the switching signal generation unit generates the second switching signal based on input data for a target horizontal scanning period and input data, that is held in the input data storing unit, for a period one horizontal scanning period before the target horizontal scanning period.

5. A drive method for a display device having a plurality of video signal lines and a video signal line drive circuit configured to drive the plurality of video signal lines, wherein the display device includes a precharge power source, as a power source for performing precharging of the plurality of video signal lines, configured to supply a precharge voltage including a voltage for a positive polarity and a voltage for a negative polarity, the precharge voltage being corresponding to only one gradation value, the drive method comprising generating a data voltage depending on input data, generating a first switching signal based on a polarity control signal for determining a polarity of the data voltage applied to each of the plurality of video signal lines, generating a second switching signal so that a precharging period whose length is determined depending on the input data is obtained, the precharging period being a period during which the precharge voltage is applied to each of the plurality of video signal lines, selecting the precharge voltage for the positive polarity or the precharge voltage for the negative polarity based on the first switching signal, and selecting the data voltage or the selected precharge voltage, based on the second switching signal.

* * * * *